US008953958B2

(12) United States Patent
Takahashi

(10) Patent No.: US 8,953,958 B2
(45) Date of Patent: Feb. 10, 2015

(54) IMAGE FORMING APPARATUS

(75) Inventor: Koji Takahashi, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 185 days.

(21) Appl. No.: 13/602,486

(22) Filed: Sep. 4, 2012

(65) Prior Publication Data

US 2013/0058666 A1 Mar. 7, 2013

Related U.S. Application Data

(60) Provisional application No. 61/531,299, filed on Sep. 6, 2011.

(51) Int. Cl.
*G03G 21/00* (2006.01)

(52) U.S. Cl.
CPC ..... *G03G 21/00* (2013.01)
USPC ..... 399/38

(58) Field of Classification Search
USPC ..... 399/38, 53–56, 341, 342, 381, 390
See application file for complete search history.

(56) References Cited

U.S. PATENT DOCUMENTS

| | | | | |
|---|---|---|---|---|
| 7,567,767 | B2 * | 7/2009 | Kikuchi | 399/82 |
| 8,449,062 | B2 | 5/2013 | Kaneko et al. | |
| 2010/0118349 | A1 | 5/2010 | Ozawa | |

FOREIGN PATENT DOCUMENTS

| | | |
|---|---|---|
| JP | 07-020666 | 1/1995 |
| JP | 08-030147 | 2/1996 |
| JP | 2005-242098 | 9/2005 |
| JP | 2010-253949 | 11/2010 |

OTHER PUBLICATIONS

Japanese Office Action for Japanese Patent Application No. 2012-196251 mailed on Mar. 11, 2014.

* cited by examiner

*Primary Examiner* — Hoan Tran
(74) *Attorney, Agent, or Firm* — Amin, Turocy & Watson, LLP

(57) ABSTRACT

According to an embodiment, an image forming apparatus transfers an unfixed developer image carried on an image carrier on a sheet of paper in a transfer section and fixes the unfixed developer image to the sheet of paper in a fixing section, and includes: a paper feeding section which accommodates a sheet of paper to be reused where the developer image is erased using a first developer including decolorizing function and feeds a paper to the transfer section, and a management information generation section which forms on the sheet of paper a developer adhesion quantity of the developer image formed on the sheet of paper to be reused as the management information using the first developer.

7 Claims, 6 Drawing Sheets

| | | COVERAGE RATE | | | |
|---|---|---|---|---|---|
| | | 0～25% | 26～50% | 51～75% | 76～100% |
| NUMBER OF IMAGE FORMATIONS | 1 | 1.00 | 1.00 | 1.00 | 1.00 |
| | 2 | 1.00 | 1.00 | 1.00 | 1.00 |
| | 3 | 1.00 | 1.00 | 1.02 | 1.05 |
| | 4 | 1.00 | 1.02 | 1.05 | 1.10 |
| | 5 | 1.02 | 1.05 | 1.10 | 1.15 |
| | 6 | 1.05 | 1.10 | 1.15 | 1.20 |

| RELATIVE HUMIDITY CORRECTION VOLTAGE TABLE | RELATIVE HUMIDITY (%) | | | | | | |
|---|---|---|---|---|---|---|---|
| | 10% | 19% | 27% | 34% | 45% | 57% | 76% |
| 64g～105g/cm² | 950 | 850 | 710 | 610 | 550 | 480 | 350 |
| 106g～160g/cm² | 1850 | 1580 | 930 | 770 | 700 | 680 | 500 |
| 161g～219g/cm² | 2580 | 2050 | 1200 | 880 | 750 | 700 | 530 |
| 220g～249g/cm² | 1970 | 1470 | 970 | 850 | 800 | 750 | 500 |
| 250g～280g/cm² | 2200 | 1730 | 1130 | 950 | 900 | 800 | 500 |

IMAGE FORMING APPARATUS

CROSS-REFERENCE TO RELATED APPLICATION

This application is based upon and claims the benefit of priority from: U.S. provisional application 61/531,299, filed on Sep. 6, 2011; the entire contents of which are incorporated herein by reference.

FIELD

Embodiments described herein relate generally to a management technique of an adhesion quantity of a decolorizing color material which is formed on a sheet of paper.

BACKGROUND

There is a decolorizing color material including an decolorizing function in which an image formed on a sheet of paper is decolorized using an external stimulus such as light having a specific wavelength, pressure and heating. In an electrophotographic image forming apparatus, a decolorizing toner as a decolorizing color material is transferred on a sheet of paper and is fixed by heat and pressure using a fixing device. Thus, an image is decolorized by applying pressure to and heating a decolorizing toner image at a decolorizing temperature higher than a fixing temperature and the sheet of paper may be reused.

However, in a sheet of paper to be reused, the image such as letter is erased from an image forming section of the sheet of paper and is not directly visible by human eyes. However, a resin configuring the decolorizing toner remains practically in the same state.

Thus, an adhesion quantity of decolorizing toner, which is adhered on the same portion on the sheet of paper, increases with an increase in the number of times of reuse sheet of paper. When the toner resin adhesion quantity formed on a sheet of paper increases, there is an effect on image formation such as transfer efficiency when transferring a toner image to the sheet of paper and fixing efficiency when fixing the toner image to the sheet of paper.

Accordingly, when the toner resin adhesion quantity that is present on a sheet of paper may be estimated before an image is formed on the sheet of paper to be reused, control targets related to the sheet of paper and the toner such as a transfer bias according to the toner adhesion quantity and a fixing temperature are controlled and reliable image may be provided.

DETAILED DESCRIPTION

Hereinafter, the image forming apparatus according to the exemplary embodiment relates to an image forming apparatus which transfers an unfixed developer image carried in an image carrier to a sheet of paper in a transfer section and fixes the unfixed developer image to the sheet of paper in a fixing section. The image forming apparatus includes a paper feeding section which accommodates sheets of paper to be reused where developer images are erased using a first developer having a decolorizing function, and feeds a sheet of paper to the transfer section; and a management information generation section which forms on the sheet of paper the developer adhesion quantity of the developer image forming on the sheet of paper to be reused with a first developer as the management information.

Hereinafter, the image forming apparatus according to the exemplary embodiment is described in detail with reference to the drawings.

As the image forming apparatus 1 of the exemplary embodiment, the description will be given in below where a MFP (Multi Function Peripheral) including an electrophotographic image forming section is exemplified.

Figure 1:
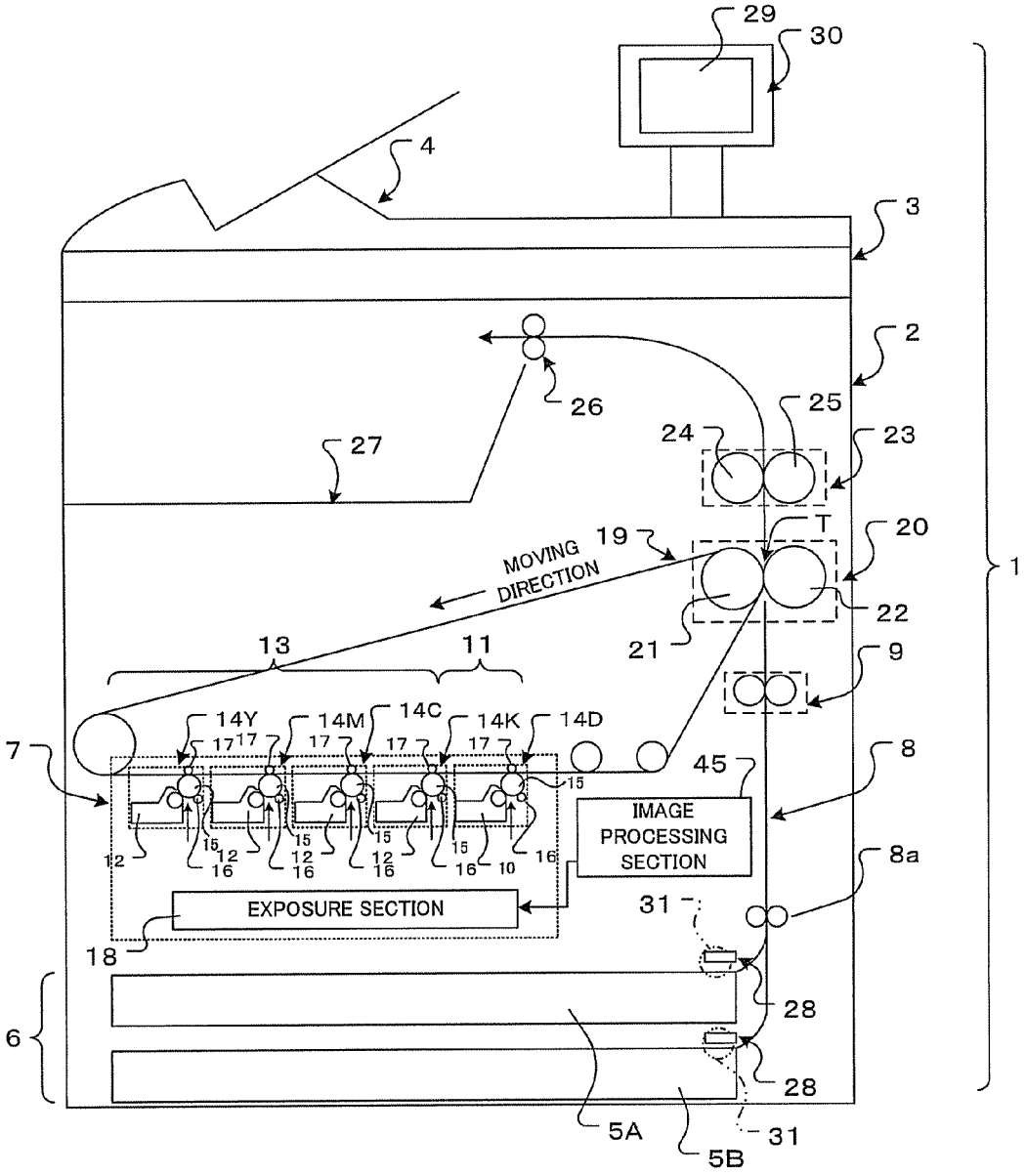
FIG. 1 is a schematic view of an image forming apparatus according to an exemplary embodiment.

In FIG. 1, the MFP 1 has an image reading section 3 such as a scanner on the upper portion of an apparatus main body 2 and an ADF (Auto Document Feeder) 4 on the upper portion of the image reading section 3. Further, the image forming apparatus main body 2 includes a paper feeding section 6 in which paper feeding cassettes 5A and 5B are arranged in up and down, an image forming section 7, and a transportation section 8 having a transportation roller 8*a* transporting the sheet of paper in the paper feeding section 6 to a secondary transfer position T. The sheet of paper, which is fed from the paper feeding cassettes 5A and 5B to the transportation section 8 using the feeding rollers 31, is transported to the secondary transfer position T with a predetermined timing using a resistor roller pair 9. In addition, the sheets of paper to be reused may be accommodated in the upper paper feeding cassette 5A and unused sheets of paper may be accommodated in the lower cassette 5B.

The image forming section 7 includes a first developing section 11 having a first developing device 10 where a first developer is accommodated which is a decolorizing color material (a decolorizing toner) that is decolorized by heating at a predetermined first temperature and is melt by heating at a second temperature lower than the first temperature thereby fixed on a sheet of paper S. In addition, the image forming section 7 includes a second developing section 13 having a second developing device 12 where second developers, which are non-decolorizing color materials (usual toners) of each color of yellow (Y), magenta (M), cyan (C) and black (K) are accommodated respectively, as well as the first developing section 11. In the exemplary embodiment, the first developing device 10 is arranged in a first process cartridge 14D and the second developing device 12 of each color is arranged in second process cartridges 14Y, 14M, 14C and 14K of each color. The first process cartridge 14D and the second process cartridges 14Y, 14M, 14C and 14K have the same structure and the first developing device 10 and the second developing device 12 are arranged around a photoconductive drum 15.

Further, a charged roller 16 and a primary transfer roller 17 are arranged to face the photoconductive drum 15. The photoconductive drum 15 includes an exposure section 18 having a laser exposure device and exposure light is irradiated from the exposure section 18 to each photoconductive drum 15, based on the image information. An electrostatic latent image is formed on the photoconductive drum 15 using the exposure light and the electrostatic latent image is developed using the first developer of the first developing device 10 and the second developer of the second developing device 12. A toner image, which is formed on each photoconductive drum 15, is transferred to a primary transfer belt 19 which endlessly rotates using the primary transfer roller 17 and moves to the transfer position T. In addition, the toner remained in the photoconductive drum 15, where a primary transfer is finished, is erased using a cleaner (not illustrated).

Meanwhile, the sheet of paper S is transported to a secondary transfer position T in a predetermined timing using the resistor roller pair 9. In the secondary transfer position T, a secondary transfer section 20 is arranged where a second transfer opposite roller 21 on which the primary transfer belt 19 is wound and rotated, and a secondary transfer bias roller 22 are arranged opposite each other. The unfixed toner, which is carried on the primary transfer belt 19, is transferred to the sheet of paper S at the transfer position T. The sheet of paper S, on which the unfixed toner image is transferred, is transported to the fixing device 23. The fixing device 23 has for example, a heating roller 24, a pressing roller 25 which is pressed to contact the heating roller 24, a heating source configured by a halogen lamp (not illustrated), for example, which heat the heating roller 24, and a temperature sensor (not illustrated) detecting a surface temperature of the heating roller 24. The fixing device 23 is configured such that the electricity to the halogen lamp (not illustrated) is controlled and then the heating temperature may be controlled. The sheet of paper passed through the fixing device 23 is discharged to a paper discharge section 27 using a paper discharge roller pair 26.

In the secondary transfer section 20, a predetermined bias voltage is applied to the secondary transfer bias roller 22 using a transfer bias control section. A correction voltage value is increased and decreased with respect to the predetermined bias voltage, based on the relative humidity according to the basis weight of the sheet of paper.

Figure 2B:
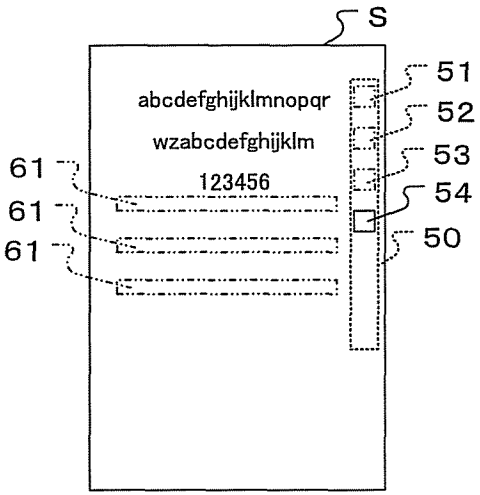
FIG. 2B is a view illustrating an example in which a decolorizing toner image is formed using reused paper with an image forming apparatus in FIG. 1.
Figure 2A:
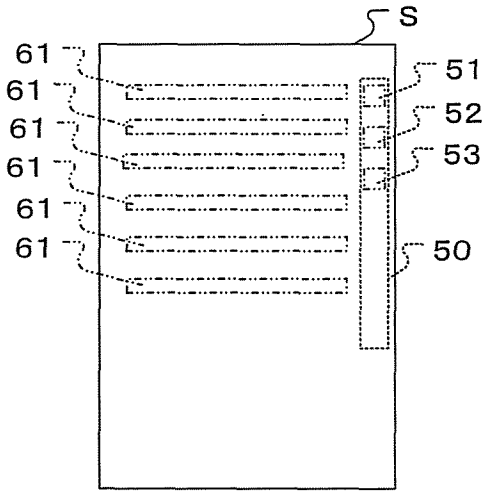
FIG. 2A is a view illustrating an example of a sheet of paper in a state where toner adhesion quantity management information is decolorized.

In the exemplary embodiment, the sheet of paper S accommodated in the paper feeding cassette 5 is checked whether or not the sheet of paper on which the toner image is formed using the first developer that is the decolorizing toner is erased and reused, and if the sheet of paper S is the sheet of paper to be reused, the information of the number of times of reuse, the coverage rate and image density is printed to the sheet of paper to be reused using the first developer as the management information of the toner adhesion quantity. As illustrated in FIGS. 2A and 2B, a print region 50 of the management information of the toner adhesion quantity may be for example, one side end portion of a long side of the sheet of paper S. Of course, the print region 50 may be provided on each side end portion of the long side and a short side thereof.

Thus, as in FIG. 2A, the sheets of paper S to be reused accommodated in the paper feeding cassettes 5A and 5B, the management information of toner adhesion quantity printed using the first developer image in the print region 50 is erased. However, the decolorizing toner may be read using a line sensor such as a CCD, because the resin portion thereof remains in the same state. In the exemplary embodiment, a management information acquiring section 28 such as a CCD line sensor, which acquires the toner adhesion quantity management information of the sheet of paper S placed on the top position of the paper feeding cassette 5, is arranged upwards the paper feeding cassette.

Whether the image formation using the first developing section 11 is performed or the image formation using the second developing section 13 is performed is selected with the operation of an operation section 30 including a monitor 29.

When the image formation by the decolorizing toner using the first developing section 11 is performed, there are two cases, one is that the sheet of paper to be reused, where the removing process is finished, is used, and the other is that the number times of reuse of the sheet of paper to be reused is many and the reuse is not suitable any more. In the latter case, for example, the sheet of paper in the lower paper feeding cassette 5B, in which the unused sheets of paper are accommodated, may be used.

As in FIGS. 2A and 2B, in the print region 50 of the management information of the toner adhesion quantity, management information 51, 52, 53 and 54 is printed using for example, QR code (registered trade mark) at a predetermined positions sequentially from end thereof according to the number of times of reuse. That is, in FIG. 2A, when determination is performed that three reusing are performed from the print positions of the management information 51, 52 and 53, a region 61 illustrated in a two-dot chain line illustrates an image erased portion. Thus, the developing image is formed on the sheet of paper to be reused using the first developer and a fixed state thereof is illustrated in FIG. 2B. In FIG. 2B, the management information 54 is printed at a position of a fourth reusing time and the image information is printed at the sheet of paper S.

Figure 3:
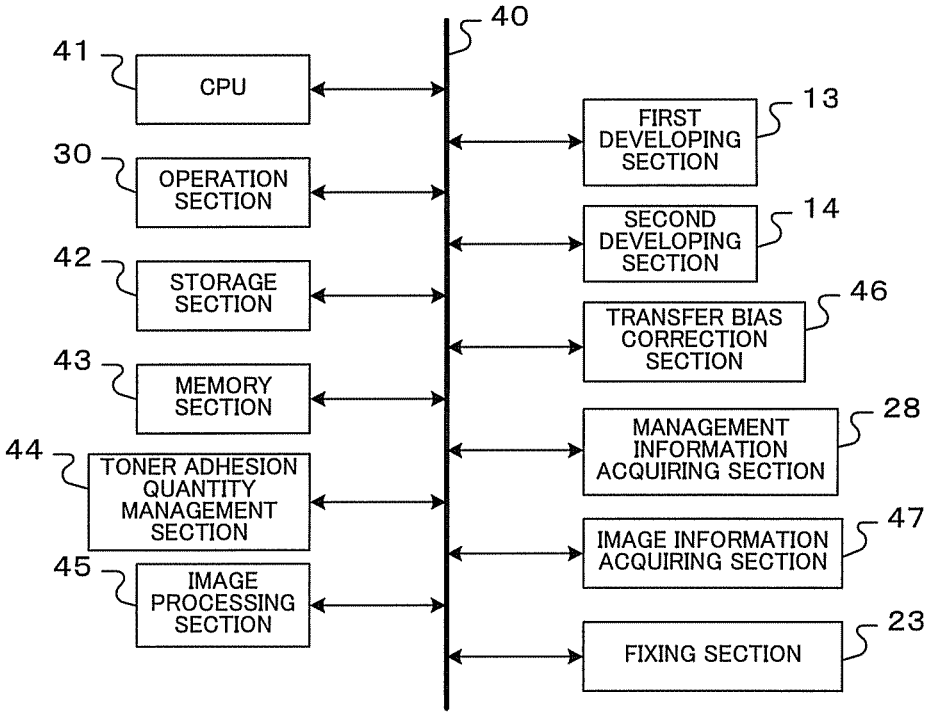
FIG. 3 is a block diagram of a correction control of a transfer bias which corrects the transfer bias according to the toner adhesion quantity in the reused paper.

A control circuit, which prints the toner adhesion quantity management information on the sheet of paper S, reads the printed management information and then adjusts a transfer bias output, is described based on FIG. 3.

In FIG. 3, a processor (a CPU) 41 which controls all of MFP 1, the operation section 30, a storage section 42, a memory section 43, a toner adhesion quantity management section 44, an image processing section 45, the first developing section 11, the second developing section 13, a transfer bias correction section 46, a management information acquiring section 28, an image information acquiring section 47 and the fixing section 23 are connected via a bus line 40.

The processor 41 performs a predetermined process based on program stored in the memory section 43 or the storage section 42, and controls the image formation operation. The memory section 43 may use for example, a RAM (Random Access Memory), a ROM (Read Only Memory), a DRAM, a SRAM (Static Random Access Memory), a VRAM (Video RAM) and a flash memory, and has a role to store various information or program used in the MFP 1.

The operation section 30 selects whether color print or monochromatic print is performed by using the first developing section 11 accommodating the decolorizing toner, or using the second developing section 13 accommodating the usual toner. In addition, the description, in which the sheets of paper to be reused are accommodated in the paper feeding cassette 5A and unused sheets of paper are accommodated in the paper feeding cassette 5B, is described. The operation section 30 may select whether the paper feeding cassette 5A is used or the paper feeding cassette 5B is used. The management information acquiring section 28 reads the decolorized management information of the toner adhesion quantity which is printed at the waiting sheet of paper S to be reused loaded on the top of the paper feeding cassette 5A, and transmits the information to the toner adhesion quantity management section 44.

The toner adhesion quantity management section 44 transmits the management information of the toner adhesion quantity in which based on the toner adhesion quantity used in the image formation of the current time is set the coverage rate and the density information (the toner adhesion quantity) of the image information of the management information acquiring section 28 to the image processing section 45, and the management information of the toner adhesion quantity is formed on the sheet of paper S with the original document image using the first developer. In addition, the total toner adhesion quantity, which adds the toner adhesion quantity with the current image formation to the toner adhesion quantity supplied to the reuse until the last time, is transmitted to the transfer bias correction section 46. The transfer bias correction section 46 obtains an increased voltage value according to the total toner adhesion quantity. Thus, the first developer image is transferred to the sheet of paper S to be reused using the transfer bias where the increased voltage value is added, and is fixed at the fixing section 23.

Figure 4:
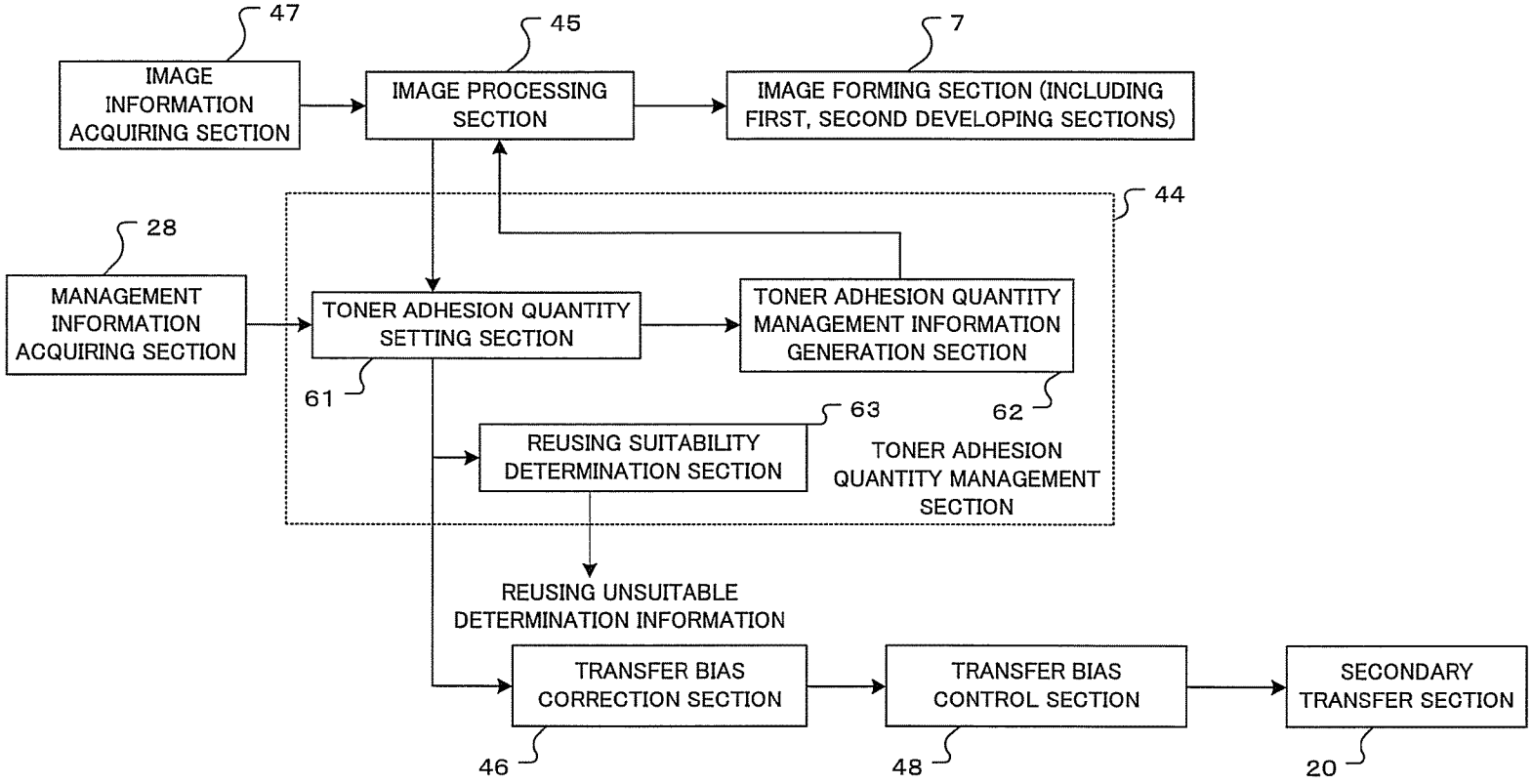
FIG. 4 is a block diagram illustrating a configuration of a toner adhesion quantity management section in FIG. 3.

FIG. 4 is a block diagram of the toner adhesion quantity management section 44. The current image information, which is acquired via the image reading section 3 that is the image information acquiring section 47 or the interface which communicates with a personal computer, is read to the memory section 31 and is transmitted to the image processing section 45. The image processing section 45 obtains the coverage rate of each page from the number of pixels in each page of current print, obtains the toner adhesion quantity of each page of current print from the density information of each page, and transmits the information to a toner adhesion quantity setting section 61.

The number of times of reuse (N, N is an integer more than or equal to 1), which is read in the management information acquiring section 28, and the management information in the past that is the management information until now, are transmitted to the toner adhesion quantity setting section 61. In other words, the current management information that is the number of times of reuse and the toner adhesion quantity of the current print, and the management information in the past that is the number of times of reuse and the toner adhesion quantity in the past are transmitted to the toner adhesion quantity setting section 61. Thus, the current management information is transmitted to a toner adhesion quantity management information generation section 62. The toner adhesion quantity management information generation section 62 transmits the management information in the current time to the image processing section 45. The image processing section 45 transmits the management information in the current time with the original document image to the image forming section 7, drives the first developing section 11 and then forms the developing image to the photoconductive drum 15 using the first developer. The first developer on the photoconductive body 15 is primarily transferred to the transfer belt 19 and is transferred to the sheet of paper S in the secondary transfer section 20.

An output value of the transfer bias applied to the secondary transfer roller 22 of the secondary transfer section 20 is adjusted by the total toner adhesion quantity that is the sum of the toner adhesion quantity in the past and the current toner adhesion quantity. The toner adhesion quantity setting section 61 transmits the information of the total toner adhesion quantity with the number times of reuse (N) to the transfer bias correction section 46. In addition, the information of the total toner adhesion quantity and the number of times of reuse (N) is output to a reusing suitability determination section 63. The reusing suitability determination section 63, determines whether or not the reuse is possible, using for example, the determination whether or not the number of times of reuse exceeds the predetermined number of times, and whether or not the total toner adhesion quantity exceeds a predetermined quantity. Thus, when determination is performed that it does not suitable for reuse, the reusing unsuitable determination information is output. When the reusing unsuitable determination information of is output, the CPU 41 stops the feeding of the paper from the paper feeding section 5A and may exemplify the instruction to the paper feeding section 6 to feed the paper from the paper feeding section 5B in which the unused sheets of paper are accommodated. In addition, in order to remove the sheet of paper S which is unsuitable for reuse from the paper feeding cassette 5A, for example, the instruction is displayed on the monitor 29 and may exemplify that the sheet of paper S is discharged outside the image forming apparatus without passing the transfer section 20.

Figures 6, 7, 8:
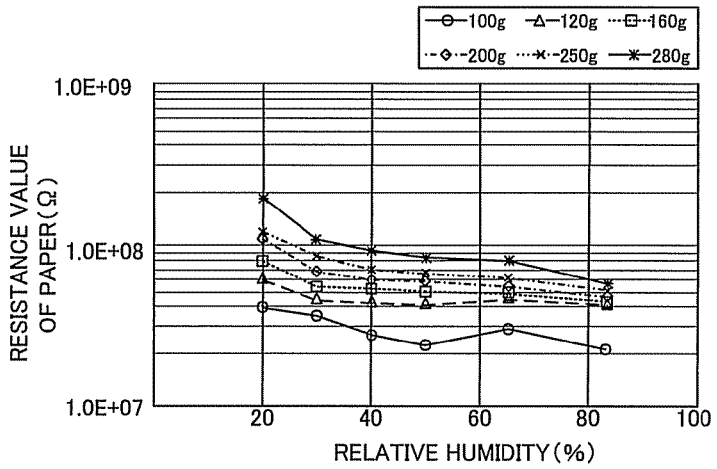
FIG. 6 is a view illustrating a correction factor of the transfer bias for each time of image formation and a coverage rate.
FIG. 7 is a view illustrating the transfer bias for each paper basis weight and relative humidity.
FIG. 8 is a view illustrating a relationship between the relative humidity and a paper resistance value of sheets of paper where basis weights are different to each other.

Meanwhile, the transfer bias correction section 46 determines for example, the correction factors illustrated in a correction table of FIG. 6, multiplies the correction factors by the transfer bias which is determined in the table of FIG. 7 and determines the output of the transfer bias. The secondary transfer bias, which is determined in the transfer bias correction section 46, is output to the transfer bias control section 48 and is output to the secondary transfer section 20.

The correction table illustrated in FIG. 6 is an example of the correction factors of the transfer bias such as the number of image formations (the number of times of reuse) and the coverage rate. For example, when the number of image formations is three and the coverage rate is 26 to 50%, the correction factor is 1.00, and when the number of image formations is six and the coverage rate is 51 to 75%, the correction factor is 1.15.

Further, the table illustrated in FIG. 7 is the transfer bias for each paper basis weight and the relative humidity. When the relative humidity is 34% in the sheet of paper of the basis weight 106 g to 160 g/cm$^2$, the transfer bias is 770 V, and for example, the correction factors 1.00 and 1.15 described above are multiplied by the voltage. In addition, the resistance value of the sheet of paper depends on the humidity environment and as illustrated in FIG. 8, the sheets of paper of the basis weights of 100 g/cm$^2$, 120 g/cm$^2$, 160 g/cm$^2$, 200 g/cm$^2$, 250 g/cm$^2$ and 280 g/cm$^2$ have characteristics that the resistance values increase in the low humidity side.

Figure 5:
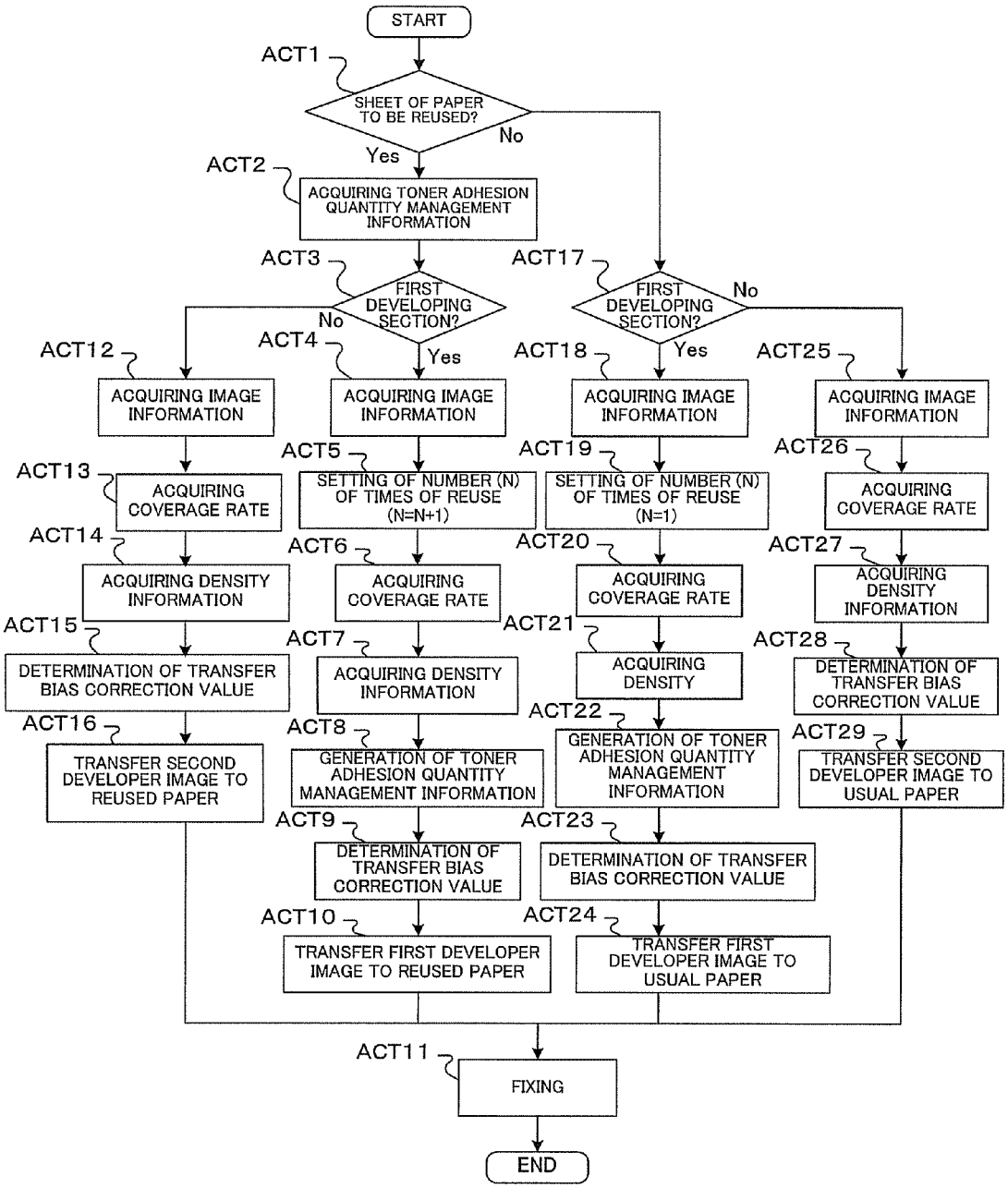
FIG. 5 is a flowchart illustrating a flow of the correction control of the transfer bias by the toner adhesion quantity management section in FIG. 4.

Next, flow of the control of the generation of the management information of the toner adhesion quantity and the correction of the transfer bias illustrated in FIG. 4 is described based on the flowchart illustrated in FIG. 5.

In ACT 1, determination is performed whether or not the sheet of paper S accommodated in the selected paper feeding cassette 5A or 5B is the sheet of paper to be reused, based on the reading information from the management information acquiring section 28. When the management information is read, determination is performed as the sheet of paper to be reused and the process proceeds to ACT 2.

In ACT 2, for example, the management information of the sheet of paper S having the state illustrated in FIG. 2A is acquired using the management information acquiring section and the process proceeds to ACT 3. The management information is the toner adhesion quantity, based on the number of times of reuse (N), the coverage rate information and the density information. The toner adhesion quantity information may be displayed on the sheet of paper for each using time or a value, which sums the toner adhesion quantity information to the final management information, may be displayed.

In ACT 3, determination is performed whether or not the first developing section 11 is selected, in other words, whether or not the repeated print is selected using the decolorizing toner, and when the first developing section 11 is selected, the process proceeds to ACT 4.

In ACT 4, the image information of the original document, which is placed on the ADF 4 or in the personal computer, is acquired using the image information acquiring section 47 and the process proceeds to ACT 5.

In ACT 5, the number of times of reuse N (N=N+1) of the current print is set, based on the management information acquired in ACT 2 and the process proceeds to ACT 6.

In ACT 6, the current coverage rate is acquired, based on the management information acquired in ACT 2 and the process proceeds to ACT 7.

In ACT 7, the current density information is acquired, based on the management information acquired in ACT 2 and the process proceeds to ACT 8.

In ACT 8, the management information is generated, based on the number of current reusing times N, the current coverage rate and the current density information, and the process proceeds to ACT 9.

In ACT 9, the sum of the current toner adhesion quantity and the toner adhesion quantity in the past is obtained and the factor for correcting the transfer bias is obtained in the transfer bias correction section 46, and the process proceeds to ACT 10.

In ACT 10, the corrected transfer bias is output to the secondary transfer section 20 and the first developer image is transferred to the sheet of paper S to be reused, and process proceeds to ACT 11.

In ACT 11, the first developer image is fixed on the sheet of paper S to be reused in the fixing section 23 and the process finishes.

Further, in ACT 3, when the second developing section 13 is selected, since the permanent image is formed on the sheet of paper to be reused using the usual toner, in ACT 12, the image information is acquired in the image information acquiring section 47 similar to ACT 4 and the current coverage rate of the image is acquired (ACT 13), the current density information of the image is acquired (ACT 14) and the process proceeds to ACT 15.

In ACT 15, the toner adhesion quantity and the number of times of reuse in the past are acquired and the factor for correcting the transfer bias is obtained in the transfer bias correction section 46, based on the total toner adhesion quantity in which the current toner adhesion quantity is added, and the process proceeds ACT 16.

In ACT 16, the corrected transfer bias is output to the transfer section and the second developer image is transferred to the sheet of paper S to be reused, and the process proceeds to ACT 11.

Meanwhile, in ACT 1, when the unused sheet of paper is selected or the toner adhesion quantity of the sheet of paper to be reused exceeds the predetermined quantity and then the reuse may not be possible, the process proceeds to ACT 17 and similar to ACT 3, determination is performed whether or not the first developing section 11 is selected, in other words, whether or not the repeated print is selected with respect to the unused sheet of paper using the decolorizing toner, and when the first developing section 11 is selected, the process proceeds to ACT 18.

In ACT 18, the image information of the original document, which is placed on the ADF 4 or in the personal computer, is acquired using the image information acquiring section 47 and the process proceeds to ACT 19.

In ACT 19, since the unused sheet of paper is used, the number of times of current reuse N of the print is set to 1 (N=1) and the process proceeds to ACT 20.

In ACT 20, the current coverage rate is acquired, based on the management information acquired in ACT 18 and the process proceeds to ACT 21.

In ACT 21, the current density information is acquired, based on the management information acquired in ACT 18 and the process proceeds to ACT 22.

In ACT 22, the management information is generated, based on the number of times of current reuse N=1, the current coverage rate and the current density information, and the process proceeds to ACT 23.

In ACT 23, the current toner adhesion quantity is obtained and the factor for correcting the transfer bias is obtained in the transfer bias correction section 46, and the process proceeds to ACT 24.

In ACT 24, the corrected transfer bias is output to the secondary transfer section 20 and the first developer image is transferred to the unused sheet of paper S, and process proceeds to ACT 11.

Further, in ACT 17, when the second developing section 13 is selected, since the permanent image is formed on the unused sheet of paper using the usual toner, in ACT 25, the image information is acquired in the image information acquiring section 47 similar to ACT 4 and the process proceeds to ACT 26.

In ACT 26, the transfer bias correction value is obtained, based on the toner adhesion quantity which is based on the coverage rate and the image density of the current image, and the process proceeds to ACT 29.

In ACT 29, the second developer image is transferred to the unused sheet of paper S with the transfer bias, based on the correction value of the transfer bias which is determined in ACT 28, the process proceeds to ACT 11, and the operation is finished.

According to the exemplary embodiment, the toner adhesion quantity adhering on the sheet of paper S to be reused may be managed using the management information of the toner adhesion quantity formed on the sheet of paper. Since the management information uses the first developer that is the same decolorizing toner as the management information, image formation of the management information is easily performed.

Further, since the management information is decolorized simultaneously with the image information, there is no problem in the reuse.

Further, since the management information of the toner adhesion quantity is acquired, correction of the transfer bias is appropriately performed to the sheet of paper to be reused and the image may be formed without transfer irregularity.

In the exemplary embodiment described above, the transfer bias is controlled, based on the sum of the toner adhesion quantity in the past which is adhered to the sheet of paper and the toner adhesion quantity which is estimated as the current toner adhesion quantity in the image formation, however, the control object is not limited to the above description.

The exemplary embodiment may be carried out in other various forms without deviating from the spirit and the main characteristics thereof. Thus, the exemplary embodiment described above is only an example and should not be interpreted restrictively. The range of the exemplary embodiment is illustrated in the claims and is not restricted by the detailed description of the specification. Furthermore, any modifications, various improvements, substitutions and reformations pertaining to the equivalent range of the claims are within the range of the exemplary embodiment.

What is claimed is:

1. An image forming apparatus which transfers an unfixed developer image carried on an image carrier on a sheet of paper in a transfer section and fixes the unfixed developer image to the sheet of paper in a fixing section, the image forming apparatus comprising:

a paper feeding section which accommodates a sheet of paper to be reused where the developer image is erased using a first developer including a decolorizing function and feeds the sheet of paper to the transfer section, and a management information generation section which forms on the sheet of paper a developer adhesion quantity of the developer image formed on the sheet of paper to be reused as the management information using the first developer.

2. The apparatus according to claim 1, wherein the management information is the number of times of reuse, a coverage rate and density of the sheet of paper to be reused.

3. The apparatus according to claim 1, wherein the management information is printed at a predetermined position of the sheet of paper to be reused.

4. The apparatus according to claim 1, further comprising:

a management information acquiring section which acquires the management information formed on the sheet of paper to be reused waiting in the paper feeding section.

5. The apparatus according to claim 4, further comprising:

a transfer bias correction section which corrects a transfer bias of the transfer section, based on the management information in the past acquired in the management information acquiring section and the management information of the developer adhesion quantity required for the image formation in the current time.

6. The apparatus according to claim 4, further comprising:

a reusing suitability determination section which determines suitability of the reusing of the sheet of paper to be reused, based on the management information in the past acquired in the management information acquiring section and the management information of the developer adhesion quantity required for the image formation in the current time.

7. The apparatus according to claim 1, further comprising:

a second developing section which develops an electrostatic latent image of the image carrier using a non-decolorizing second developer.

* * * * *